US006494490B1

(12) United States Patent
Trantoul

(10) Patent No.: US 6,494,490 B1
(45) Date of Patent: Dec. 17, 2002

(54) METHOD FOR PRODUCING A PARTICULAR PHOTOLUMINESCENT POLYCHROMATIC PRINTED IMAGE, RESULTING IMAGE AND USES

(76) Inventor: François Trantoul, Mas du Cantadou, 1312 chemin du Pont des Anes, 34400 Lunel (FR)

( * ) Notice: Subject to any disclaimer, the term of this patent is extended or adjusted under 35 U.S.C. 154(b) by 0 days.

(21) Appl. No.: 09/582,102

(22) PCT Filed: Oct. 22, 1999

(86) PCT No.: PCT/FR99/02573

§ 371 (c)(1),
(2), (4) Date: Jun. 22, 2000

(87) PCT Pub. No.: WO00/24587

PCT Pub. Date: May 4, 2000

(30) Foreign Application Priority Data

Oct. 23, 1998 (FR) ..... 98 13307

(51) Int. Cl.[7] ..... B42D 15/00

(52) U.S. Cl. ..... 283/91; 283/67; 283/70; 101/211

(58) Field of Search ..... 283/67, 70, 93, 283/94, 91, 109; 156/1; 430/139; 101/211, 483, 115, 129, 171

(56) References Cited

U.S. PATENT DOCUMENTS

| | | | | |
|---|---|---|---|---|
| 2,277,169 A | | 3/1942 | Switzer et al. | |
| 2,302,645 A | | 11/1942 | Switzer et al. | |
| 2,434,019 A | | 1/1948 | Switzer et al. | |
| 2,629,956 A | | 3/1953 | Switzer et al. | |
| 3,663,813 A | * | 5/1972 | Shaw | 350/315 |
| 3,907,402 A | * | 9/1975 | Friesem | 350/35 |
| 4,299,904 A | * | 11/1981 | Pettijohn et al. | 430/139 |
| 5,232,527 A | | 8/1993 | Vernhet | |
| 5,429,047 A | | 7/1995 | Marmolejo et al. | |

FOREIGN PATENT DOCUMENTS

| | | |
|---|---|---|
| DE | 678 234 | 6/1939 |
| DE | 196 20 090 | 11/1997 |
| EP | 0 089 629 | 9/1983 |
| EP | 0 271 941 | 6/1988 |
| EP | 0 308 389 | 3/1989 |
| FR | 1 205 166 | 2/1960 |

OTHER PUBLICATIONS

R.J. Tuite, "Fluorecent Multicolor Additive System", *Product Licensing Index,* No. 84, Industrial Opportunities Ltd. Havant, Great Britain, Apr. 1971, pp. 81–85.

* cited by examiner

*Primary Examiner*—William Fridie, Jr.
(74) *Attorney, Agent, or Firm*—Young & Thompson

(57) ABSTRACT

A process for producing any photoluminescent printed polychromatic image (8), and the image obtained thereby. At least one set of at least three monochromatic filtered images (6*a*, 6*b*, 6*c*) is prepared from any original polychromatic image (1) visible in visible light which is filtered with a spectral pass-band below or equal to 15 nm, according to at least three wavelengths of fundamental colors equal to the wavelengths of the luminescent pigments used, with the corresponding monochromatic filtered images (6*a*, 6*b*, 6*c*), in order to print separately, one above the other, three monochromatic printed images (8*a*, 8*b*, 8*c*). The invention concerns the image obtained, a protective device and a document carrying such an image.

34 Claims, 3 Drawing Sheets

METHOD FOR PRODUCING A PARTICULAR PHOTOLUMINESCENT POLYCHROMATIC PRINTED IMAGE, RESULTING IMAGE AND USES

FIELD OF THE INVENTION

The invention concerns a process for producing any photoluminescent printed polychromatic image (namely one which can incorporate all the shades of colours and various forms possibly including continuous variations of colours (shaded, fading etc., shadows, intensity variations, mottled effects etc.) invisible under illumination with visible light and visible under illumination by at least one source of invisible light, designated hereinafter in all the text as "any photoluminescent printed polychromatic image".

"Visible light" designates a light of which the spectral composition is situated in the visible spectrum from $0.4\mu$ to $0.8\mu$. "Invisible light" designates a light of which the spectral composition is situated outside the visible spectrum, in particular in the ultra violet and/or the infra red spectrum.

BACKGROUND OF THE INVENTION

Photoluminescent printed monochromatic markings which are invisible under illumination with visible light and visible under illumination with invisible light (ultraviolet or infra red) are often used for the purpose of the authentication of documents such as bank notes. Different printed monochromatic markings may be juxtaposed and/or superimposed, which create spots of colours composed of a finite number and in a discontinuous manner.

Nevertheless, these photoluminescent monochromatic markings do not make it possible to produce a true photoluminescent printed polychromatic image reproducing, with all the shades of colours and forms, any polychromatic image visible in visible light such as a photographic image which is not in half-tone and is non-digitized.

Any photoluminescent printed polychromatic image of this type may be of value in many fields and may have various applications, in particular as an authentication element and/or for the purposes of decoration.

As regards authentication, any photoluminescent printed polychromatic image may provide at least three levels of authentication: printing the image creates raised patterns and/or an opalescence visible in visible light; under illumination in invisible light, it is possible to verify the conformity of the image which is extremely difficult to counterfeit perfectly taking into account its complexity and the fact that it is applied to the background of a document provided with other designs visible by transparency, unless the original is available which is visible under visible light, reproduction from the image visible in invisible light not providing the original image; and spectrophotometric analysis enables the photoluminescent compounds used to be identified and therefore their authentic character.

For decorative purposes, any photoluminescent printed polychromatic image of this type proves to have a an unusual special appearance when illuminated in invisible light.

However, various attempts to produce a photoluminescent printed polychromatic image of this type which date back more than sixty years have ended in failure.

In particular, traditional printed polychromatic images visible in visible light are generally produced in quadrichrome (yellow, magenta, cyan, black) on a white background. The original image is filtered with three coloured filters (blue, green, red) having a spectral pass-band of $100\mu$ (a third of the visible spectrum). The appearance of colours on the printed image is due to the reflection of natural visible light (daylight or an illuminating lamp) by the printed substrate through the transparent coloured inks which selectively absorb the incident light according to the so-called "material colour" principle by subtractive synthesis. For each coloured ink, the substrate reflects two thirds of the visible spectrum, according to a complementary spectral composition of the absorption spectrum of the ink in the visible region. With this technique, it is not possible to produce a photoluminescent printed polychromatic image. Indeed, if photoluminescent pigments are used corresponding to the fundamental colours of the coloured filters used for printing in quadrichrome, in inks which are printed from three negatives obtained after filtering with the aid of traditional coloured filters, it is not possible in practice to reproduce the polychromatic image in a photoluminescent manner, reliably and with good quality.

THE KNOWN PRIOR ART

U.S. Pat. Nos. 2,302,645, 2,277,169 and 2,434,019 thus describe various attempts to produce images with the aid of fluorescent pigments.

Nevertheless, the processes described in these documents do not make it possible to produce a photoluminescent printed polychromatic image by automatic and reliable reproduction of a polychromatic image. Indeed, the processes described in these documents consist of manually producing, in the first instance, a trichromatic positive. Subsequently, this trichromatic positive is used to be reproduced by printing with the aid of inks, certain of which incorporate fluorescent pigments. As a consequence, these documents show that the automatic obtaining of a trichromatic photoluminescent positive has been abandoned, since these documents consider that the positive is out of necessity produced manually.

Equally, the document R. J. TUITE "Fluorescent multicolor additive system" XP 002108747, PRODUCT LICENSING INDEX, no84, pages 81–85, INDUSTRIAL OPPORTUNITIES LTD, HAVANT, GB ISSN: 0374–4353, April Issue, 1971, teaches the production, by printing with the aid of a gravure plate press, of a multicoloured image which is fluorescent under ultraviolet light. The process used in this document consists of producing negatives with red, green and blue separation from a continuous positive by exposure through a red, green and blue filter, respectively. With this process, since each of the negatives has not been finely filtered, the largest proportion of the area of the final image includes an abnormal surcharge of the three colours forming a dominant white. On account of this, the fluorescent image obtained is extremely pale and is in practice either invisible or a "phantom" image, in spite of the production of a large number of successive final layers of green ink.

OBJECTS OF THE INVENTION

The object of the invention is therefore in a general manner to enable any photoluminescent printed polychromatic image to be produced. Accordingly, the object of the invention is to make it possible to reproduce in a printed photoluminescent form and in an automatic and reliable manner, any original polychromatic photographic image formed by subtractive synthesis (material colour principle) and which is visible in visible light (printed, painted, photographic image etc).

The invention also aims at providing a simple and low-cost process for rapidly obtaining and reproducing such an image on the industrial scale, automatically and reliably, in particular in a manner similar to traditional printing techniques, without requiring the manual production of a trichromic positive by an artist, and while providing a high quality and high contrast image.

The invention also aims at providing applications for any kind of photoluminescent printed polychromatic image.

SUMMARY OF THE INVENTION

To this end, the invention concerns a process for producing any photoluminescent printed polychromatic image invisible under illumination in visible light and visible under illumination by at least one source of invisible light, wherein:

an original polychromatic image 1, visible in visible light, is chosen or is produced by subtractive synthesis (material colour principle), at least one set of at least three images, known as filtered images, is produced and recorded by filtering the original image, at least one set of at least three images, known as printed images, is printed separately one after the other and one above the other, by using and reproducing respectively one of the filtered images, with a printing composition containing a photoluminescent pigment, the different photoluminescent pigments of the different printed images of the same set emitting, under illumination by at least one source of invisible light, colours capable of forming all the colours of the visible spectrum by additive synthesis, wherein:

filtered images, known as monochromatic filtered images, are produced by filtering the original image in a spectral pass-band lower than or equal to 15 nm centred on a wavelength, known as the filtering wavelength, chosen from the wavelengths of at least three fundamental colours, the different filtering wavelengths of the monochromatic filtered images being distinct in pairs and being adapted so as to enable all the colours of the visible spectrum to be formed by additive synthesis, each of these filtering wavelengths being at least approximately equal to a wavelength of an emission peak of a photoluminescent pigment under illumination by at least one source of invisible light, each printed image, called the monochromatic printed image, is printed by using and reproducing one of the monochromatic filtered images with a printing composition containing a photoluminescent pigment having an emission wavelength peak under illumination by at least one source of invisible light, which is at least approximately equal to the filtering wavelength used for obtaining the said monochromatic filtered image.

"At least approximately equal" means either perfect equality between wavelengths or the fact that the wavelengths are sufficiently close for their difference to produce no appreciable effect on the image obtained. In particular, the wavelength of the emission peak may be situated in all the pass-band below or equal to the filtering wavelength, to within 15 nm. In other words, a certain margin of error is accepted for wavelengths and this margin of error is of the order of the pass-band of the filters used.

Advantageously, a process according to the invention is also characterized by at least one of the following characteristics :

in order to produce each of the monochromatic filtered images, an original of any original polychromatic image visible in visible light is illuminated, and the polychromatic image reflected by this illuminated original is filtered in a spectral pass-band below or equal to 15 nm centred on the filtering wavelength of the fundamental colour corresponding to the monochromatic filtered image and, advantageously, the reflected polychromatic image is filtered with pass-band filters having a spectral pass-band of the order of 10 nm, in particular interference pass-band filters;

there are chosen, by way of filtering wavelengths and emission peaks of the photoluminescent pigments (by selecting suitable filtering means and photoluminescent pigments) of different monochromatic printed images of the same set forming a reproduction of an original image, at least one wavelength in the green region, at least one wavelength in the red region and at least one wavelength in the blue region; and advantageously, wavelengths are chosen adapted so that they are separated by the same spectral distance of between 80 nm and 100 nm, in particular equal to 90 nm; in particular a wavelength in the green region of between 520 and 570 nm, a wavelength in the red region of between 610 and 680 nm and a wavelength in the blue region of between 430 and 480 nm;

the monochromatic printed images are printed so that, in the order in which the illuminating light is received, they exhibit the filtering wavelengths and the emission peaks of the photoluminescent pigments in the order blue, red and green and the monochromatic printed images are printed one on the others without an intermediate layer;

for the same set forming a reproduction of an original polychromatic image, only three monochromatic printed images are printed, one in green, one in red and one in blue, and each monochromatic printed image is printed in a single print layer;

in order to produce and record each monochromatic filtered image, the filtered image is captured by charge transfer photosensitive means, CCD, a corresponding digitized image is recorded and there is formed, from each monochromatic filtered image, a half-tone image which is then used to print the monochromatic printed image, and advantageously the half-tone image has a half-tone of 60 to 133, in particular of the order of 80 (this value corresponding to the number of lines or dots per inch (2.54 cm);

the different monochromatic printed images of the same set are printed at least substantially with the same print thickness; each monochromatic printed image is printed so that the quantity of photoluminescent pigment at each point is a function of the luminous intensity of the original polychromatic image at this point according to the corresponding filtering wavelength (this function being proportional in the case of a positive and inversely proportional in the case of a negative); and photoluminescent pigments are used having a purity factor (ratio of the quantity of monochromatic light according to the dominant wavelength of the emission peak to the sum of this quantity of monochromatic light and the quantity of emitted white light) equal to 1, virtually monochromatic light having a main emission peak or monochromatic light having a single emission peak;

each monochromatic printed image is allowed to dry and/or harden after it has been printed and before another monochromatic printed image is printed;

in order to produce the same set of monochromatic printed images, pigments are used which are photoluminescent under illumination by one and the same source of invisible light and as a variant, in order to produce the same set of monochromatic printed images, at least one first pigment is used which is photoluminescent under illumination by at least one first source of invisible light, and at least one second pigment which is photoluminescent under illumination by at least one second source of invisible light with a wavelength or with wavelengths distinct from that or those of the first source of invisible light;

a set is printed of monochromatic printed images which are positive images of an original image, adapted so as to reproduce a positive of the original image by additive synthesis;

a set is printed of monochromatic printed images which are negative images of an original image, adapted so as to reproduce a negative of the original image by additive synthesis;

a first set of positive monochromatic printed images is printed with pigments which are photoluminescent under illumination by a first source of invisible light (in particular infrared or ultraviolet light) and a second set of negative monochromatic printed images is printed with pigments which are photoluminescent under illumination by a second source of invisible light with a wavelength which is distinct from that of the first source of invisible light, in particular infrared or ultraviolet;

the wavelengths of the emission peaks of the photoluminescent pigments used to print the first set are at least approximately equal to the wavelengths of the emission peaks of the photoluminescent pigments used for printing the second set, so that the same monochromatic filtered images can serve to print the two sets;

there is additionally printed at least one image, known as an infrared image, with a printing composition containing at least one pigment having at least one peak emission wavelength situated in the infrared region but with no emission in the visible light region when this pigment is activated by illumination under a source of visible light; the infrared image is a monochrome image which may be of the same nature (positive or negative) as the monochromatic printed images or, preferably, of the opposite nature; it is also possible to provide a first positive set and a second negative set, as indicated above, and a positive or negative infrared image;

in order to print each monochromatic printed image a printing composition is used which incorporates a photoluminescent pigment but which is, at least after drying, transparent or translucent for visible light when placed under illumination by the source of invisible light or by each of the sources of invisible light and in addition, advantageously, in order to print each monochromatic printed image, a printing composition is used which is, at least after drying, transparent or translucent for visible light when placed under illumination in visible light;

the monochromatic printed images are printed by screen printing and advantageously a printing composition is used formed of a screen printing varnish polymerizable under ultraviolet radiation, and a printing screen is produced from each monochromatic filtered image and different printing screens are produced from the same fabric;

pigments are used which are photoluminescent under illumination by at least one source of invisible light of which the spectral composition is situated in the ultraviolet or infrared regions;

inorganic photoluminescent pigments are used, in particular of the family of rare earths, and as a variant organic photoluminescent pigments are used with better transparency (least opalescence) but which are less durable than inorganic pigments;

the monochromatic printed images are printed successively on the free outer face of a transparent film in the visible region including at least one layer formed of a continuous impression of a printed composition, for example a film such as described in EP-0 271 941 or U.S. Pat. No. 5,232,527.

The invention thus makes it possible to obtain, for the first time, any photoluminescent printed polychromatic image automatically which is a true reproduction, with all the shades of colours and forms which can vary infinitely in a continuous manner, from an original of any original polychromatic image visible in visible light. This original may be printed or may be a memorized analog image (photographic, cinematographic, video..) or a digitized image memorized on a computer bulk memory or another.

It should be noted that this result is not obtained by using wide band filtration as in traditional printing but on the contrary selective filtration with a narrow band in visible light and a trichromatic additive synthesis under illumination in invisible light.

The invention also extends to the printed image obtained by a process according to the invention.

The invention thus concerns any photoluminescent printed polychromatic image invisible under illumination in visible light and visible under illumination by at least one source of invisible light, including at least one set of at least three images, known as printed images, printed one above the other, each printed image including a photoluminescent pigment emitting a colour under illumination by a source of invisible light, the different colours of the printed images of the same set being adapted so as to be able to form by additive synthesis all the colours of the visible spectrum under illumination by at least one source of invisible light, wherein each printed image, known as the monochromatic printed image, corresponds to the filtration of an original polychromatic image by subtractive synthesis visible in visible light, in a spectral pass-band below or equal to 15 nm centred on a wavelength, known as the filtration wavelength, chosen from the wavelengths of at least three fundamental colours, the different filtration wavelengths being distinct in pairs and adapted so that they can form all the colours of the visible spectrum by additive synthesis, each of these filtration wavelengths being at least approximately equal to a wavelength of an emission peak of the photoluminescent pigment of the corresponding monochromatic printed image.

Advantageously, an image according to the invention is also characterized by at least one of the following characteristics:

it includes at least one monochromatic printed image having at least one emission peak wavelength in the green region, at least one monochromatic printed image having at least one emission peak wavelength in the red region and at least one monochromatic printed image having at least one emission peak wavelength in the blue region; and for the same set of monochromatic printed images forming a reproduction of an original image, it comprises three monochromatic printed images, one in the green, one in the red and one in the blue region;

the wavelengths of the emission peaks of the monochromatic printed images are separated by the same spectral distance of between 80 nm and 100 nm, in particular of the order of 90 nm; and advantageously they comprise a monochromatic printed image having an emission peak wavelength in the green region of between 520 and 570 nm, a monochromatic image having an emission peak wavelength in the red region of between 610 and 680 nm and a monochromatic printed image having an emission peak wavelength in the blue region of between 430 and 480 nm;

the monochromatic printed images of the same set follow each other, in the order in which the light is received, in the order blue, red, green of the wavelengths of the emission peaks and advantageously the monochromatic printed images are stacked on each other without an intermediate layer, the monochromatic printed images having at least substantially the same print thickness;

each monochromatic printed image is formed of a printing composition which is transparent or translucent for visible light when it is placed under illumination by the source of invisible light, or by each of the sources of invisible light, and which incorporates a photoluminescent pigment, each monochromatic printed image being formed of a printing composition which is transparent or translucent for visible light when it is placed under illumination in visible light;

the photoluminescent pigments of at least the same set of monochromatic printed images emit under illumination by at least one source of invisible light of which the spectral composition is situated in the ultraviolet or infrared regions; the different monochromatic printed images of the same set include photoluminescent pigments emitting under illumination by at least one source of invisible monochromatic light; advantageously, the different photoluminescent pigments of at least the same set of monochromatic printed images are adapted so as to have an emission peak wavelength under illumination by one and the same source of invisible light; and as a variant, for at least the same set of monochromatic printed images, at least one first pigment is photoluminescent under illumination by at least one first source of invisible light, and at least one second pigment which is photoluminescent under illumination by at least one second source of invisible light with a wavelength or wavelengths distinct from that or those of the first source of invisible light;

it comprises several sets of monochromatic printed images visible under illumination by different sources of light (for example one set forming a reproduction visible under ultraviolet light and one set forming a reproduction visible under infrared light);

it comprises a first set of positive monochromatic printed images including pigments which are photoluminescent under illumination by a first source of invisible light, in particular ultraviolet or infrared light, and adapted so as to reproduce a positive of an original polychromatic image by additive synthesis, and a second set of negative monochromatic printed images including pigments which are photoluminescent under illumination by a second source of invisible light with wavelengths distinct from that of the first source of invisible light, in particular ultraviolet or infrared light, and adapted so as to reproduce a negative of an original polychromatic image by additive synthesis, these two sets being capable of being superimposed and being reproductions of the same polychromatic original image, one negative and the other positive, and as a variant being reproductions of two different original images;

it additionally includes at least one image, known as an infrared image, visible in the infrared region but invisible in the visible light region under illumination by a source of visible light; it being possible for this infrared image to be an inverse reproduction of an original polychromatic image produced by a set of monochromatic printed images on the same substrate, and to be capable of being superimposed on this set.

The invention also extends to applications for an image according to the invention. The invention extends in particular to the application of an image according to the invention for the protection of a document, in particular a passport, an identity card, a driving licence, a vehicle registration document or other official document for identification and/or authentication, a fiduciary document such a bank note, a cheque, a card or other document of payment.

The invention thus concerns a device for protecting a document including at least one transparent protective film for covering and protecting at least a portion of the area of a document, in which the film includes at least one image according to the invention.

The invention also concerns a document, in particular a passport, an identity card, a driving licence, a vehicle registration document or other official document for identification and or authentication, a fiduciary document, a bank note, a cheque, a card or other document of payment, including at least one image according to the invention. Advantageously and according to the invention, at least one image according to the invention is carried by at least one transparent protective film applied on at least one face of the document.

The invention also concerns a process, any photoluminescent printed polychromatic image, a protective device and a document characterized in combination by all or part of the characteristics mentioned above or hereinafter.

BRIEF DESCRIPTION OF THE DRAWINGS

Other objects, characteristics and advantages of the invention will become apparent on reading the following description which refers to the accompanying figures in which.

DETAILED DESCRIPTION OF THE INVENTION

Figure 1:
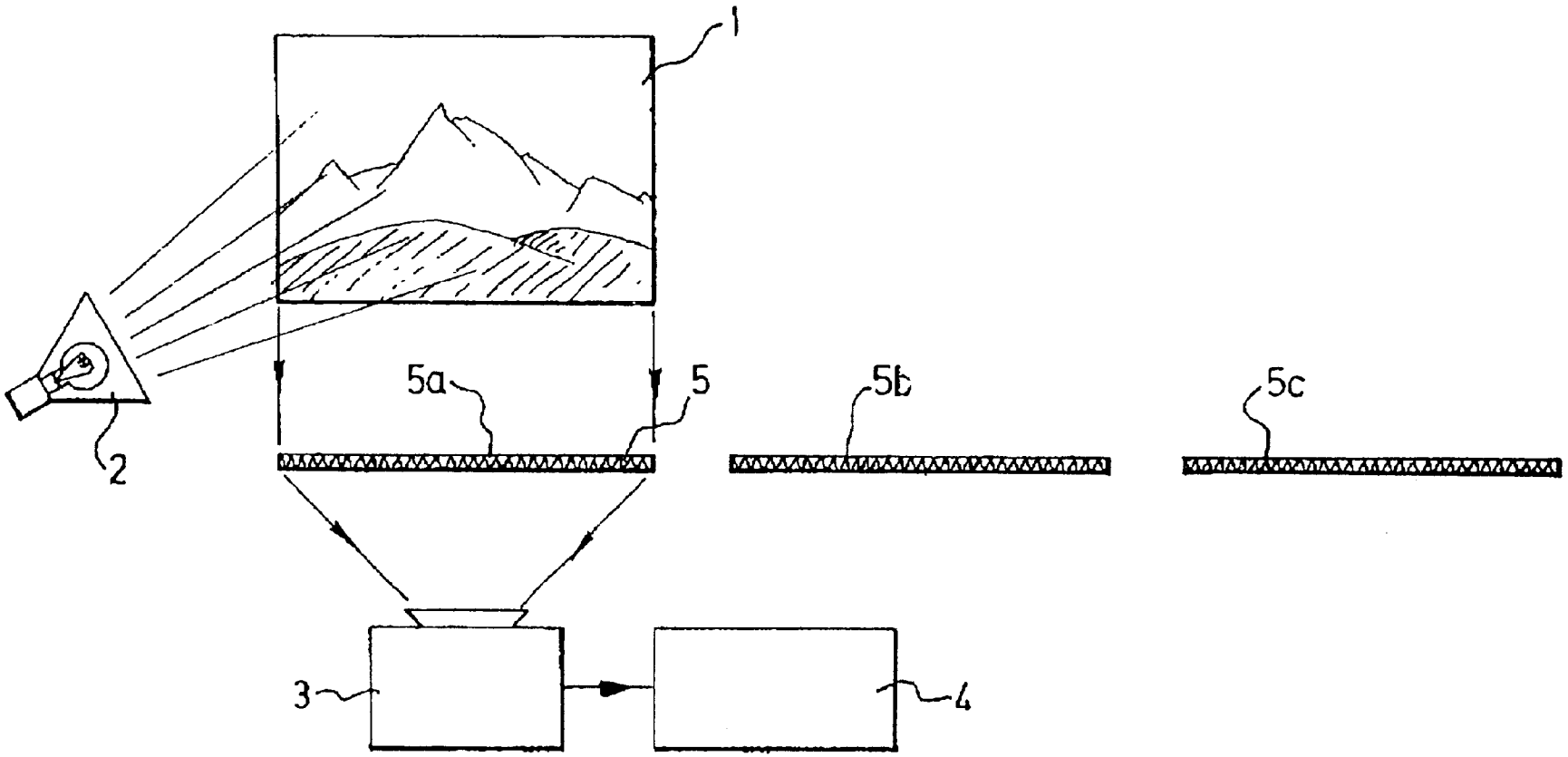
FIG. 1 is a diagram illustrating an installation for implementing the process according to the invention.
Figure 2:
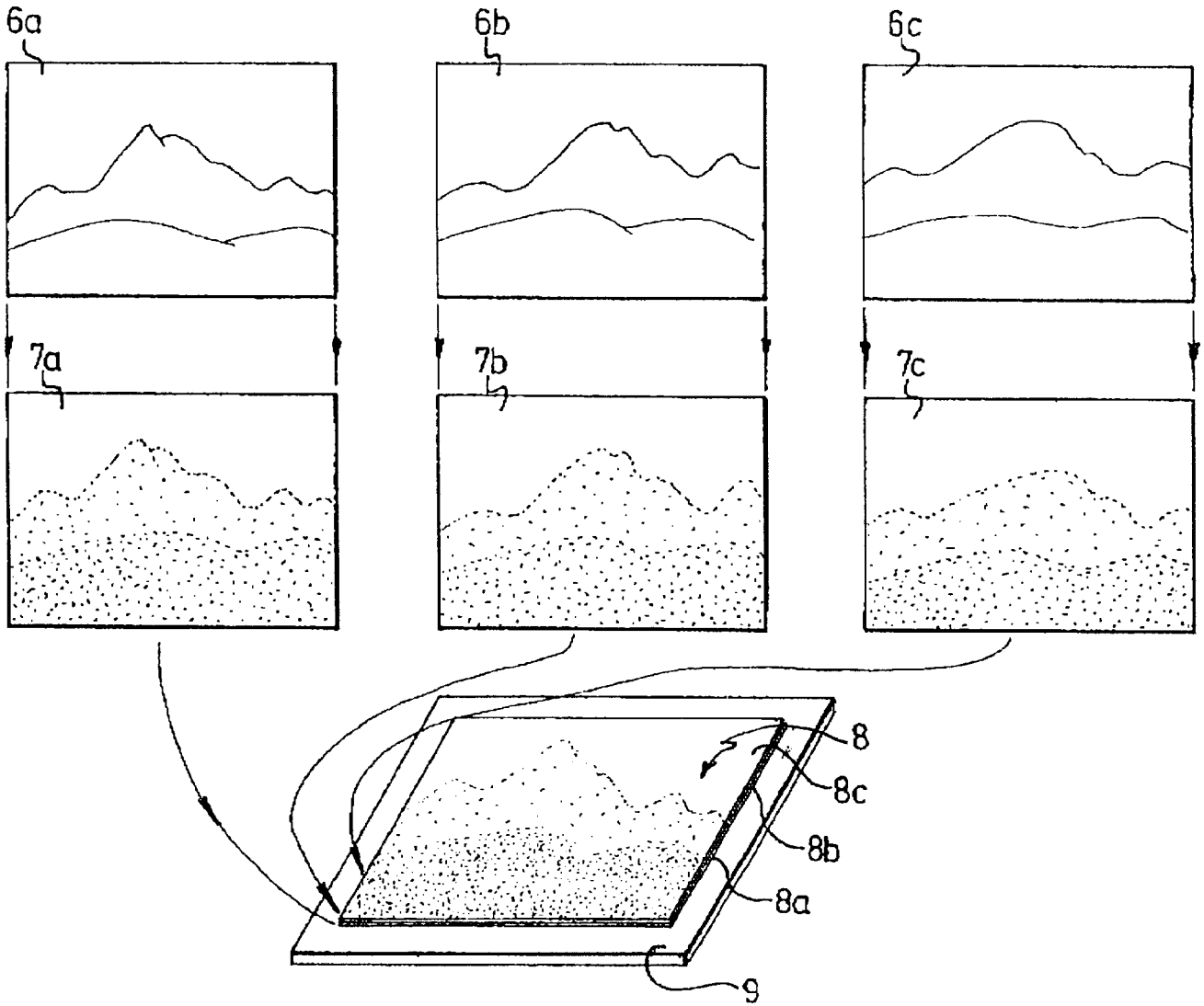
FIG. 2 is a diagram illustrating various steps of a process according to the invention.

FIG. 1 shows an original polychromatic image 1 coloured according to the material colour principle (subtractive synthesis) visible in visible light such as a photograph or an image printed in traditional quadrichrome, which it is desired to reproduce with all the shades of colours and shapes, by obtaining any photoluminescent printed polychromatic image invisible under illumination in visible light and visible under illumination by at least one source of invisible light. An original of this original image 1 is illuminated by a source of visible light 2 such as an incandescent lamp or daylight. The light illuminating the original image 1 is a visible white light which is reflected by the original image 1 in the direction of a CCD camera 3 connected to a microcomputer 4 enabling the images captured by the camera 3 to be memorized. A pass-band filter 5 is interposed on the optical path of the reflected light. This filter 5 is chosen from at least three pass-band interference filters 5*a,* 5*b,* 5*c* of which the spectral pass-band is below 15 nm, in particular of the order of 10 nm, and of which the filtering wavelength is chosen at least approximately equal to the wavelength of an emission peak of a pigment which is photoluminescent under illumination by at least one source of invisible light, this pigment being moreover adapted so that it can enable the polychromatic image to be subsequently printed, i.e. in order to be compatible with the printing means and techniques used, as described hereinafter. The filtering wavelengths are chosen from the wavelengths of at least three fundamental colours which can form all the colours of the visible spectrum by additives synthesis. In particular, three wavelengths are sufficient provided each fundamental colour cannot be balanced by the other two. It is also possible to use more than three wavelengths.

The monochromatic image coming from the filter 5 is a contrasted monochromatic filtered image. The camera 3 is thus a monochrome camera. Three monochromatic filtered images 6*a,* 6*b,* 6*c* are produced in this way from the same original image 1 with each of the three monochromatic filters 5*a,* 5*b,* 5*c* respectively. These three monochromatic filtered images 6*a,* 6*b,* 6*c* are digitized images and are recorded in the microcomputer 4. Each monochromatic filtered image 6*a,* 6*b,* 6*c* captured and digitized by the CCD camera 3 is recorded by the microcomputer 4.

As a variant, not shown, the original polychromatic image may be a recorded digitized image and numeral filtering means are used to produce each monochromatic filtered image 6*a,* 6*b,* 6*c* by calculating software. It is also possible to use the numerical filtering by a scanner having a transfer function adapted to the filtering wavelengths.

Three printing half-tones 7*a,* 7*b,* 7*c,* imaged in a manner which is traditional in the field of screen printing, are then produced from the three filtered monochromatic filtered images 6*a,* 6*b,* 6*c,* using a 60 to 133 half-tone, in particular of the order of 80. The fineness of the half-tone is adapted according to the viscosity of the printing composition and its solids content in a manner known in the field of screen printing.

These printing half-tones 7*a,* 7*b,* 7*c* are each formed of a film carrying a contrasted image of which the density of the points of the half-tone at each point of the image corresponds to the luminous intensity of the polychromatic image which it is desired to reproduce.

In the case where it is desired to produce a positive reproduction of an original image 1, the density of the points of the half-tone at each point of the contrasted image of the printed half-tone which, as a negative, corresponds to the luminous flux of the original polychromatic image 1 reflected at this point, according to each filtering wavelength respectively. It is thus necessary in this case to produce an inversion of the monochromatic filtered images 6*a,* 6*b,* 6*c* which are positives, in order to obtain negative half-tones by screen printing 7*a,* 7*b,* 7*c*. This inversion may be achieved either by software processing the image captured by the CCD3 camera, or with the aid of traditional image processing software from digitized and recorded images, or by the processing software for the imager enabling the printing half-tones to be produced.

In the case on the other hand where it is desired to produce a negative reproduction of the original image 1, the monochromatic filtered images 6*a,* 6*b,* 6*c* are not inverted and the screen half-tones 7*a,* 7*b,* 7*c* are positives.

Printing half-tones 7*a,* 7*b,* 7*c* are produced on transparent films making it possible to produce printing screens by exposure of a photopolymer to daylight, one screen for each monochromatic filtered image 6*a,* 6*b,* 6*c*.

Each screen is produced for example from a fabric of which the mesh comprises 165 threads/cm, the threads having a diameter of 27 $\mu$. A layer of photopolymeric material is used having a thickness of 18 $\mu$.

Each screen is thus representative, for each filtering wavelength, of a luminous flux reflected by the original polychromatic image 1 in the filtering wavelength corresponding to the filter used or of the inverse of this luminous flux.

Three images, referred to a monochromatic printed images 8*a,* 8*b,* 8*c,* with the same format corresponding to the format of any photoluminescent printed polychromatic image 8 which it is desired to form, are then printed separately onto a printing substrate 9, one after the other and one above the other (with or without a transparent intermediate layer being interposed). The printing substrate 9 may be of any nature as long as it is compatible with the printing technique used. Advantageously, this printing substrate 9 is itself non-luminescent, in particular free from optical brighteners, so as not to disturb the chromatic equilibrium of the image 8 to be formed. For each monochromatic printed image 8*a,* 8*b,* 8*c,* a screen is used produced from one of the monochromatic filtered images 6*a,* 6*b,* 6*c* and a transparent printing composition containing a photoluminescent pigment of which the emission peak wavelength, under illumination by at least one source 14 of invisible light, is equal to the filtering wavelength used in order to obtain the said monochromatic filtered image. By using the three screens successively, corresponding to the three monochromatic filtered images 6*a,* 6*b,* 6*c,* the three monochromatic printed images 8*a,* 8*b,* 8*c* are printed successively.

Inorganic pigments are advantageously used as photoluminescent pigments, chosen in particular from the rare earths, which are very suitable for printing by the screen process and which withstand radiation from the source of invisible light, which ensures the maintenance of chromatic equilibrium with time. Organic pigments can also be chosen, the ageing stability of which is not quite as good but which have better transparency.

For the monochromatic filter 5, it is possible to use for example pass-band interference filters marketed by the LOT ORIEL Company (Courtaboeuf, France) as mentioned in the following table, which also gives examples of references of the corresponding photoluminescent pigments which can be used, marketed by the RIEDEL DE HAN Company (Germany) (RDH in the table) or by the USR OPTONICS Company (New Jersey, USA) (USR in the table).

| Reference | Provider | Type | Excitation wavelength | Emission peak and filtering wavelength | Filter |
|---|---|---|---|---|---|
| CD 144 | RDH | Inorganic blue | 365 nm | 440 nm | 44 OFS 10-50 |
| CD 105 | RDH | Inorganic red | 365 nm | 620 nm | 62 OFS 10-50 |

-continued

| Reference | Provider | Type | Excitation wavelength | Emission peak and filtering wavelength | Filter |
|---|---|---|---|---|---|
| CD 166 | RDH | Inorganic green | 365 nm | 530 nm | 53 OFS 10-50 |
| CD 463 | RDH | Inorganic green | 365 nm | 530 nm | 53 OFS 10-50 |
| P 22 | USR | Inorganic red | 365 nm | 620 nm | 62 OFS 10-50 |
| 2205 | USR | Inorganic blue | 365 nm | 480 nm | 48 OFS 10-50 |
| CD 329 | RDH | Organic blue | 365 nm | 460 nn | 46 OFS 10-50 |
| CD 308 | RDH | Organic green | 365 nm | 510 nn | 51 OFS 10-50 |
| CD 335 | RDH | Organic red | 365 nm | 620 nn | 62 OFS 10-50 |
| Red UC 6 | RDH | Inorganic red | 980 nm | 660 nm | 66 OFS 10-50 |
| Green UC 6 | RDH | Inorganic green | 980 nm | 550 nm | 55 OFS 10-50 |
| Blue UC 6 | RDH | Inorganic blue | 980 nm | 480 nm | 48 OFS 10-50 |

For each impression of a monochromatic printed image 8*a,* 8*b,* 8*c,* the chosen pigment is incorporated in a screen printing varnish chosen so as to be transparent or at least translucent when it is dry and placed under illumination by the source(s) of invisible light 14, at least for the light with a wavelength corresponding to the emission peak wavelength of this photoluminescent pigment, and for each of the emission peak wavelengths of the photoluminescent pigment(s) of the monochromatic printed image(s) previously printed on the printing substrate 9. In this way, the light emitted by each of the photoluminescent pigments will be able to pass through the screen printing varnish so as to be visible from the outside, and this without disturbing the equilibrium of the colours.

For example, with the pigments CD144, CD166 and CD105, the concentrations of each pigment in the screen printing varnish may be as follows: 27% for the blue pigment, 27% for the red pigment and 13.5% for the green pigment. These values may be reduced or increased (provided that the composition can be printed) on condition that the relative proportions of the different colours are observed for chromatic equilibrium.

The three blue, red and green monochromatic printed images 8*a,* 8*b,* 8*c,* are printed on the substrate 9 starting with the monochromatic printed image 8*a* of which the photoluminescent pigment emits in the green region (wavelength of 530 nm in the above example), then by printing the monochromatic printed image 8*b* of which the photoluminescent pigment emits in the red region (wavelength of 620 nm in the above example), and finishing with the monochromatic printed image 8*c* of which the photoluminescent pigment emits in the blue region (wavelength of 440 nm in the above example).

In this way, the different monochromatic printed images 8*a,* 8*b,* 8*c* are presented in the order 8*c* blue, 8*b* red and 8*a* green with the emission wavelengths of the photoluminescent pigments, in the order in which the invisible light causing this emission is received.

The screen printing varnish used must also be transparent to the wavelength of the invisible light source 14 (or of the sources of invisible light when several sources are used), so as enable the different pigments to be photoluminescent.

The different monochromatic printed images 8*a,* 8*b,* 8*c* are printed successively, either directly on top of each other, while allowing a drying time between each layer, or optionally by interposing continuous transparent layers between them. Such a transparent layer is for example a layer of a polymerizable two-component printing composition containing a hydroxylated polyol and an isocyanate or a polyisocyanate so as to bring about the in situ polymerization of the mixture leading to a thin transparent film of polyurethane, as described, for example, in EP-0 271 941 or U.S. Pat. No. 5,232,527.

The monochromatic printed images 8*a,* 8*b,* 8*c* are all printed with the same printing equipment (the screens used being manufactured from the same fabrics and with the same photopolymeric material). In particular, the monochromatic printed images 8*a,* 8*b,* 8*c* are printed with the same print thickness. This thickness is advantageously comprised between 3 $\mu$ and 12 $\mu$ according to the characteristics of the screen used, in particular of the order of 5 $\mu$ in the above example. The actual thickness of the monochromatic image 8*a,* 8*b,* 8*c* at each point depends of course on the design of the image, as is always the case in screen printing. Accordingly, for each positive monochromatic printed image 8*a,* 8*b,* 8*c,* the quantity of photoluminescent pigment at each point is a function of the luminous intensity of the original polychromatic image at this point according to the corresponding filtering wavelength.

The screen printing varnish used incorporating the photoluminescent pigment is chosen so as to be itself non-photoluminescent so as to enable the image 8 to be subsequently formed by additive synthesis by the three pigments of the three monochromatic images 8*a,* 8*b,* 8*c.* Moreover, advantageously, the different monochromatic printed images 8*a,* 8*b,* 8*c* are transparent or translucent in visible light when they are placed under illumination by visible light, so that the image 8 formed is itself totally transparent or translucent for visible light when it is placed under illumination by visible light. In this way, it makes it possible to visualize, by transparency, any details 12 which may have been previously inscribed on the substrate 9. The screen printing varnish used is advantageously a varnish which can be polymerized under ultraviolet radiation. In point of fact, inorganic photoluminescent pigments are generally sensitive to temperature.

In the example given above, the photoluminescent pigments all have the same absorption spectrum and emit visible light at a single emission peak under illumination by a source of invisible light 14, for example ultraviolet with a wavelength equal to 365 nm. Nothing however prevents the combination of different pigments having absorption spectra which may be different, for example a photoluminescent pigment of which the absorption spectrum is included in the long ultraviolet region (it being possible for the corresponding source of invisible light to emit a wavelength of the order of 365 nm) and/or a photoluminescent pigment of which the absorption spectrum is situated in the short ultraviolet region (it being possible for the corresponding source of invisible light to emit an emission wavelength of the order of 250 nm) and/or a photoluminescent pigment of which the absorption spectrum is situated in the infrared region (it being possible for the source of invisible light to emit a wavelength of the order of 950 nm). The value of using photoluminescent pigments having different absorption spectra is the need to use several different sources of invisible light in order subsequently to visualize the image, which reinforces the protection obtained against falsification.

The production of a photoluminescent polychromatic image 8 has been described above, formed of a set of three monochromatic printed images 8*a,* 8*b,* 8*c.* It is possible to produce several sets of similar images on the same printing substrate 9, from several original polychromatic images 1 and/or with photoluminescent pigments visible under illumination by different sources of invisible light (distinct wavelengths) and/or of different natures (negative or positive). In particular, it is possible to produce, for example, a first set of images which are photoluminescent under ultraviolet with pigments which are photoluminescent under ultraviolet and which form a positive of the original image 1, visible under ultraviolet illumination but invisible under illumination in visible light; and a second set of images which are photoluminescent under infrared with pigments which are photoluminescent under infrared which form a negative of the original image 1, visible under infrared illumination but invisible under illumination in visible light. Accordingly, when the substrate 9 is visualized under illumination by an ultraviolet source, a positive of the original image 1 appears, whereas when the substrate 9 is visualized under illumination by an infrared source, a negative of the original image 1 appears.

Other similar variants are possible. For example, it is possible to produce two successive positives on the same substrate 9, one visible under ultraviolet and the other under infrared. It is also possible to produce more than two reproductions, by printing more than two sets of images, superimposed or not superimposed. The number of sets of images which it is possible to superimpose is limited by the transparency properties of the different printed layers and by the number of different excitation light sources available.

The different sets of monochromatic printed images may be printed successively, the two photoluminescent reproductions thus formed being superimposed on each other. On the other hand, as a variant, the monochromatic printed images of the different sets may be interlaced. For example, it is possible to print first of all the different monochromatic images with green pigments and then the different monochromatic printed images with red pigments and then the different monochromatic printed images with blue pigments.

Preferably, in order to produce two polychromatic reproductions on the same substrate 9 which are photoluminescent under illumination by two different sources, photoluminescent pigments are chosen of which the emission peak wavelengths are at least approximately equal so as to use the same monochromatic filtered images 6*a,* 6*b,* 6*c* to produce these two photoluminescent reproductions. It is sufficient to produce the inversion of these monochromatic filtered images during the preparation of the printing screens in order to obtain positive polychromatic reproductions, and not to produce this inversion in order to obtain the negative polychromatic reproduction.

It should be noted that since the emission intensities of the pigments with excitation under infrared are less than those of the pigments with excitation under ultraviolet, the concentration of pigments with infra red excitation must be greater in the printing varnish than that of pigments with excitation under ultraviolet.

Moreover, it is possible to print at least one image, known as an infrared image, with a printing composition including at least one pigment, known as an infrared pigment, having at least one emission peak wavelength situated in the infrared region, but no emission in visible light when this pigment is activated by illumination under a source of visible light. Such an infrared image is a monochrome image which will be visible in the infrared region but will remain invisible in the visible light region. A single infrared image is printed on the same substrate 9 or several infrared images which are juxtaposed or offset (i.e. not superimposed).

For example, a polychromatic reproduction 8 is produced which is photoluminescent under ultraviolet or infrared light as indicated above which is a positive reproduction of the original image, and then an infrared image which is a negative reproduction of the original image. As a variant, the infrared image is a positive while the photoluminescent polychromatic reproductions are negatives. Since the excitation sources of the pigments are different, nothing will actually prevent an infrared image being printed as a positive or negative, on the same printing substrate 9, on two superimposed photoluminescent polychromatic reproductions 8 produced as indicated above.

In order to produce an infrared image, a printing composition is used containing for example the varnish reference CD170 marketed by the RIEDEL DE HAN Company (Germany). In addition, the reflected image of the original image 1 is used, captured by the CCD3 camera without filtering, and the stages of half-tone printing, possible inversion, imaging, daylight printing, developing and printing are carried out as described above.

In order to read such an infrared image, the substrate 9 is illuminated with a source of visible light. Preferably, a source of light is used, filtered in a spectral band of 40 nm to 100 nm centred on 585 nm. The infrared image formed is then read, for example by means of an infrared camera or a CCD camera, via a high-pass filter having a cut-off threshold of 800 nm filtering light coming directly from the source of visible excitation light.

The printing substrate 9 may be a transparent protective film or a transparent layer of such a film, so that the image 8 according to the invention is carried by, or incorporated in, a protective film. For example, the image 8 according to the invention may be formed inside a transparent protective film as described by EP-0 271 941 or U.S. Pat. No. 5,232,527.

Figure 3:
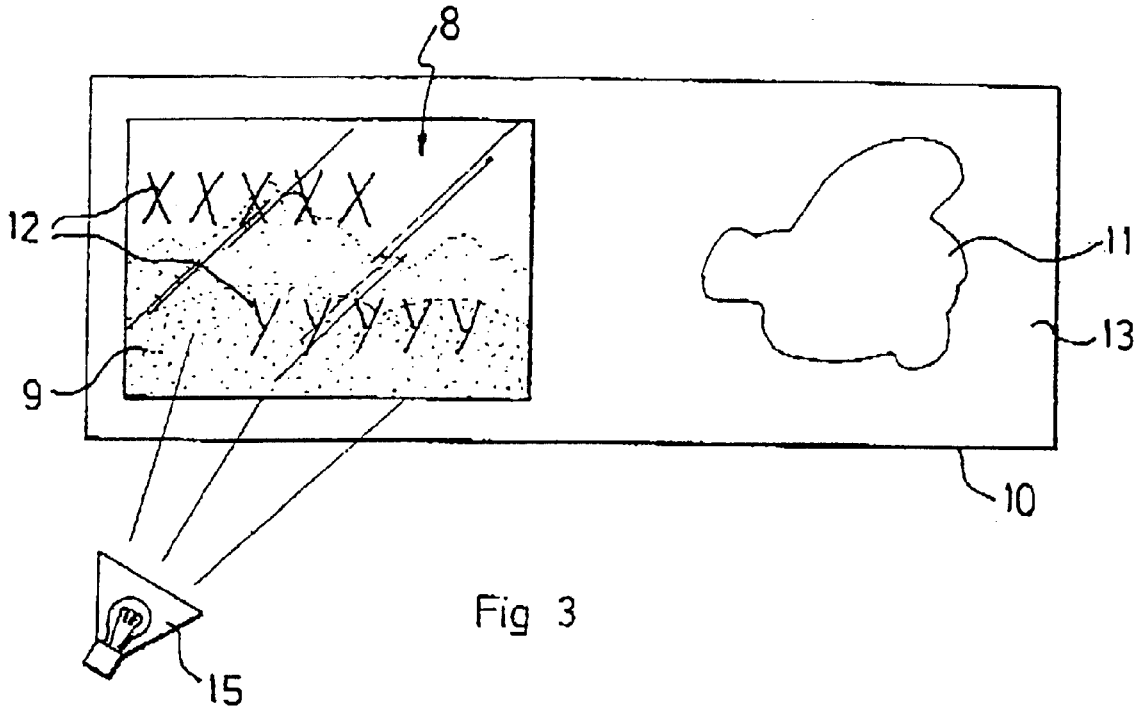
FIG. 3 is a diagram showing an example of a document protected by a protective device according to the invention, seen illuminated in visible light.
Figure 4:
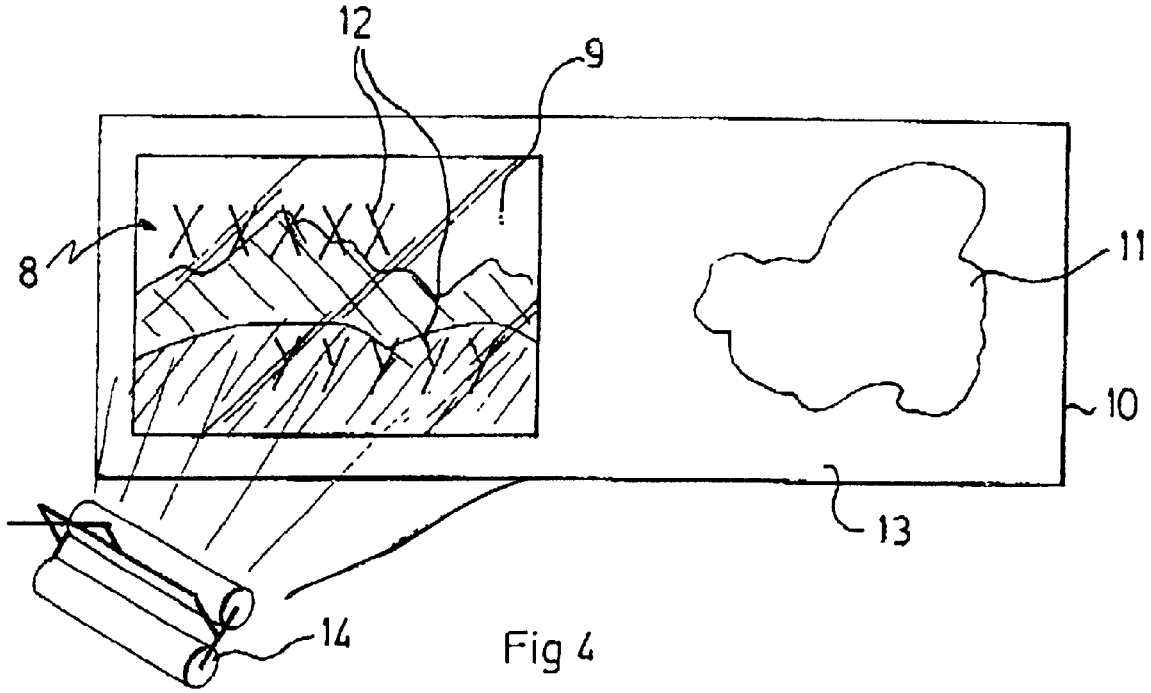
FIG. 4 is a diagram showing the document of FIG. 3 illuminated in invisible light.

FIGS. 3 and 4 represent an example of an application for a transparent protective film 9 carrying any photoluminescent printed polychromatic image 8 according to the invention. This film 9 is applied onto part of a face 13 of a document 10 to act as a means of authentication. The face 13 of the document 10 is covered with an image 11 visible in visible light and common or variable details 12 visible by transparency through the film 9 when the latter is illuminated in visible light. As can be seen in FIG. 3 where the document 10 is only illuminated by a source of visible light 15, the image 8 carried by the film 9 is not visible in visible light. Indeed, the image 8 is formed of a composition which is transparent in visible light and the photoluminescent pigments do not emit light in visible light. The presence of photoluminescent pigments in the image 8 has the practical consequence, in general, of making it slightly bleached and translucent. Moreover, in particular when the monochromatic printed images 8*a,* 8*b,* 8*c* are printed by screen printing with inorganic pigments, the variations in thickness of the designs of these different images create an opalescence on the surface (represented diagrammatically by the dots in FIG. 3) which make it possible to distinguish certain contours of the image 8 but without, for all that, making it possible to see the contours precisely or, especially, the colours of the polychromatic image.

In the situation represented in FIG. 4, the document 10 is illuminated by a source 14 of invisible light corresponding to the absorption spectrum of the different photoluminescent pigments of a set of monochromatic printed images 8*a,* 8*b,* 8*c* of the image 8. Where appropriate, several sources of invisible light should be used for exciting the photoluminescent pigments of the image 8. Accordingly the polychromatic image 8 appears in a photoluminescent manner with all its shades of colour, identical to the original polychromatic image 1. The photoluminescence creates in addition a certain decorative and surprising effect, the colours appearing with unusual luminosity and chromatic purity according to the principle of the light colour. The photoluminescent polychromatic image 8 is superimposed on the details 12 carried on the face 13 of the document which are still visible by transparency through the film 9 and the image 8.

The document 10 protected in this way may be a passport, an identity card, a driving licence, a vehicle registration document or other official identification or authentication documents, a fiduciary document such as a bank note, a cheque, a card or other document of payment.

The film 9 may be applied onto the face 13 of the document 10 in a traditional manner, by means of an adhesive layer, for example by cold dry transfer or by hot lamination. The film 9 may itself be a an anti-falsification film which can incorporate identification marks or marks preventing its reproduction by optical reading. Since the transparent image 8 is applied to the document, it cannot be counterfeited on account of the other details 12 of the document or details incorporated into the film 9 which, by being combined with the image 8, prevent its reproduction by illumination in invisible light and filtering. The photoluminescent printed polychromatic image 8 also protects the document 10 from any reproduction by optical reading in visible light, for example by photocopying or other means. In addition, it is possible to combine several images according to the invention on the same document. For example, the details 12 of the document may be themselves formed at least partly of an image according to the invention printed on the face 13 of the document. In this case, it is advantageous to use pigments for the second image which are different from those of the first image.

The invention is also applicable purely in a decorative or advertising manner for producing images 8 which are particularly aesthetic and produce a surprising effect. According to whether the source of invisible light for exciting the photoluminescent pigments is switched on or off, the image 8 may be made to appear or disappear intermittently.

EXAMPLE 1

With the process described above, a polychromatic image according to the invention which was photoluminescent under ultraviolet light was printed onto white paper free from optical brightener starting from an original quadrichrome printed image formed from a complete continuous visible coloured spectrum. The inorganic pigments CD144, CD105 and CD116 were used. It was observed that the image according to the invention perfectly reproduced the coloured spectrum under illumination in ultraviolet light.

EXAMPLE 2

A quadrichrome printed landscape image in A4 format was used which was reproduced by a process according to the invention as described above on the free face of an adhesive polyurethane transparent protective film marketed by the FASVER Company (France) under the name FASPROTEK®, in the corresponding format. This transparent film was then applied to an official document to be protected carrying a pre-printed text. It was observed that the film did not prevent the pre-printed text from being read. The screen-printed image formed opalescent relief portions visible under low incidence. It was not visible in visible white light. The image appeared with all its shades of colour under illumination by an ultraviolet lamp.

EXAMPLE 3

With the process described above, the following were printed successively onto the same white paper free from optical brightener:

- a polychromatic reproduction which was photoluminescent under ultraviolet reproducing as a positive the complete continuous visible coloured spectrum, with the pigments CD329, CD308 and CD335,
- a polychromatic reproduction which was photoluminescent under infrared reproducing as a negative the complete continuous visible coloured spectrum, with the pigments UC6 red, UC6 green and UC6 blue,
- an infrared image reproducing as a negative the complete continuous visible coloured spectrum, with the pigment CD170.

Under illumination by a source of ultraviolet light the polychromatic image of the spectrum appeared as a positive. Under illumination by a source of infrared light the polychromatic image of the spectrum appeared as a negative. Under illumination in visible light, no image appeared which was visible in visible light. Under illumination in visible light filtered at 585 nm and detection in infrared via an 800 nm high-pass filter by a CCD camera, an image was observed which was a monochromatic negative of the spectrum.

The invention may be the subject of many alternative embodiments in relation to the embodiments described and represented. In particular, printing techniques other than screen printing may be used, on condition that the photoluminescent pigments used are compatible with these printing techniques. Printing may be carried out on a substrate other than a transparent film 9, and the original polychromatic image 1 need not be a photographic or printed image but may be an image, previously digitized in a computerized system, which is printed for example with the aid of a colour laser printer so as to enable it to be filtered by the filters 5, or even an image which is filtered by numerical calculation.

What is claimed is:

1. In a process for producing a photoluminescent printed polychromatic image (8) invisible under illumination in visible light and visible under illumination by at least one source (14) of invisible light, comprising:

choosing or producing by subtractive synthesis an original polychromatic image (1), visible in visible light, producing and recording at least one set of at least three images, known as filtered images **(6*a*, 6*b*, 6*c*), by filtering the original image (1), printing separately one after the other and one above the other at least one set of at least three images, known as printed images (8*a*, 8*b*, 8*c*), by using and reproducing respectively one of the filtered images (6*a*, 6*b*, 6*c*), with a printing composition containing a photoluminescent pigment, the different photoluminescent pigments of the different printed images of the same set emitting, under illumination by at least one source (14)** of invisible light, colors capable of forming all the colors of the visible spectrum by additive synthesis; the improvement comprising:

producing filtered images, known as monochromatic filtered images **(6*a*, 6*b*, 6*c*), by filtering the original image (1) in a spectral pass-band lower than or equal to 15 nm centred on a wavelength, known as the filtering wavelength, chosen from the wavelengths of at least three fundamental colors, the different filtering wavelengths of the monochromatic filtered images being distinct in pairs and being such as to enable all the colors of the visible spectrum to be formed by additive synthesis, each of these filtering wavelengths being at least approximately equal to a wavelength of an emission peak of a photoluminescent pigment under illumination by at least one source (14) of invisible light, and printing each printed image, known as the monochromatic printed image (8***a,* 8*b,* 8*c*), by using and reproducing one of the monochromatic filtered images (6*a,* 6*b,* 6*c*) with a printing composition containing a photoluminescent pigment having an emission peak wavelength under illumination by at least one source (14) of invisible light, which is at least approximately equal to the filtering wavelength used for obtaining the said monochromatic filtered image (6*a,* 6*b,* 6*c*).

2. A process as claimed in claim 1 wherein, in order to produce each of the monochromatic filtered images (6*a,* 6*b,* 6*c*), an original of any original polychromatic image (1) visible in visible light is illuminated, and the polychromatic image reflected by this illuminated original is filtered in a spectral pass-band below or equal to 15 nm centred on the filtering wavelength of the fundamental colour corresponding to the monochromatic filtered image (6*a,* 6*b,* 6*c*).

3. A process as claimed in claim 2, wherein the reflected polychromatic image (1) is filtered with monochromatic filters (5*a,* 5*b,* 5*c*) having a spectral pass-band of the order of 10 nm, in particular interference pass-band filters (5*a,* 5*b,* 5*c*).

4. A process as claimed in one of claims 1 to 3, wherein there is chosen, as filtering wavelengths and the emission peaks of the photoluminescent pigments, at least one wavelength in the green region, at least one wavelength in the red region and at least one wavelength in the blue region.

5. A process as claimed in claim 4, wherein the wavelengths are chosen so that they are separated by a same spectral distance of between 80 nm and 100 nm, in particular equal to 90 nm.

6. A process as claimed in claim 4, wherein a wavelength is chosen in the green region of between 520 and 570 nm, a wavelength is chosen in the red region of between 610 and 680 nm and a wavelength is chosen in the blue region of between 430 and 480 nm.

7. A process as claimed in claim 4, wherein the monochromatic printed images (8*a,* 8*b,* 8*c*) are printed so that, in the order in which the illuminating light is received, they exhibit the filtering wavelengths and the emission peaks of the photoluminescent pigments in the order blue, red and green.

8. A process as claimed in claim 1, wherein, in order to record the monochromatic filtered images (6*a,* 6*b,* 6*c*), the filtered image is captured by charge transfer photosensitive means CCD (3), a corresponding digitized image is recorded and there is formed, from each monochromatic filtered image, a digitized and half-tone image (7*a,* 7*b,* 7*c*) which has a half-tone of 60 to 133 and which is then used for printing the monochromatic printed image (8*a,* 8*b,* 8*c*).

9. A process as claimed in claim 1, wherein the monochromatic printed images (8*a,* 8*b,* 8*c*) are printed at least substantially with the same print thickness, and so that the quantity of photoluminescent pigment at each point is a function of the luminous intensity of the original polychromatic image (1) at this point according to the corresponding filtering wavelength, and photoluminescent pigments are used having a purity factor equal to 1.

10. A process as claimed in claim 1, wherein each monochromatic printed image (8*a,* 8*b,* 8*c*) is allowed to dry and/or harden after it has been printed and before another monochromatic printed image (8*a,* 8*b,* 8*c*) is printed.

11. A process as claimed in claim 1, wherein in order to produce the same set of monochromatic printed images (8*a,* 8*b,* 8*c*) pigments are used which are photoluminescent under illumination by one and the same source (14) of invisible light.

12. A process as claimed in claim 1, wherein in order to produce the same set of monochromatic printed images (8*a,* 8*b,* 8*c*) at least one first pigment is used which is photoluminescent under illumination by at least one first source of invisible light, and at least one second pigment which is photoluminescent under illumination by at least one second source of invisible light with a wavelength or with wavelengths distinct from that or those of the first source of invisible light.

13. A process as claimed in claim 1, wherein a set is printed of monochromatic printed images (8*a,* 8*b,* 8*c*) which are positive images of an original image (1), adapted so as to reproduce a positive of the original image (1) by additive synthesis.

14. A process as claimed in claim 1, wherein a set is printed of monochromatic printed images which are negative images of an original image (1), adapted so as reproduce a negative of the original image (1) by additive synthesis.

15. A process as claimed in claim 13, wherein a first set of positive monochromatic printed images (8*a,* 8*b,* 8*c*) is printed with pigments which are photoluminescent under illumination by a first source of invisible light (in particular infrared or ultraviolet light) and wherein a second set of negative monochromatic printed images (8*a,* 8*b,* 8*c*) is printed with pigments which are photoluminescent under illumination by a second source of invisible light with a wavelength which is distinct from that of the first source of invisible light, in particular infrared or ultraviolet.

16. A process as claimed in claim 15, wherein the wavelengths of the emission peaks of the photoluminescent pigments used to print the first set are at least approximately equal to the wavelengths of the emission peaks of the photoluminescent pigments used for printing the second set, so that the same monochromatic filtered images (6*a,* 6*b,* 6*c*) can serve to print the two sets.

17. A process as claimed in claim 13, wherein there is additionally printed at least one image, known as an infrared image, with a printing composition containing at least one pigment having at least one emission peak wavelength situated in the infrared region but with no emission in the visible light region when this pigment is activated by illumination under a source of visible light.

18. A process as claimed in claim 1, wherein in order to print each monochromatic printed image (8*a,* 8*b,* 8*c*), a printing composition is used which incorporates a photoluminescent pigment but which is, at least after drying, transparent or translucent for visible light when placed under illumination by the source (14) of invisible light or by each of the sources of invisible light.

19. A process as claimed in claim 1, wherein in order to print each monochromatic printed image (8*a,* 8*b,* 8*c*), a printing composition is used which is, at least after drying, transparent or translucent for visible light when placed under illumination in visible light.

20. A process as claimed in claim 1, wherein the monochromatic printed images (8*a,* 8*b,* 8*c*) are printed by screen printing, a screen printing screen is produced from each monochromatic filtered image (6*a,* 6*b,* 6*c*) and different screen printing screens are produced from the same fabric, and wherein a printing composition is used formed of a screen printing varnish polymerizable under ultraviolet radiation.

21. A process as claimed in claim 1, wherein pigments are used which are photoluminescent under illumination by at least one source (14) of invisible light of which the spectral composition is situated in the ultraviolet or infrared regions.

22. In a photoluminescent printed polychromatic image invisible under illumination in visible light and visible under illumination by at least one source (14) of invisible light, including at least one set of at least three images, known as printed images (8*a,* 8*b,* 8*c*), printed one above the other, each printed image (8*a,* 8*b,* 8*c*) including a photoluminescent pigment emitting a color under illumination by a source of invisible light, the different colors of the printed images (8*a,* 8*b,* 8*c*) of the same set being such as to be able to form by additive synthesis all the colors of the visible spectrum under illumination by at least one source (14) of invisible light; the improvement in which each printed image, known as the monochromatic printed image (8*a,* 8*b,* 8*c*), corresponds to the filtration of an original polychromatic image (1) by subtractive synthesis visible in visible light, in a spectral pass-band below or equal to 15 nm centred on a wavelength, known as the filtration wavelength, chosen from the wavelengths of at least three fundamental colors, the different filtering wavelengths being distinct in pairs and adapted so that they can form all the colors of the visible spectrum by additive synthesis, each of these filtering wavelengths being at least approximately equal to a wavelength of an emission peak of the photoluminescent pigment of the corresponding monochromatic printed image (8*a,* 8*b,* 8*c*).

23. A polychromatic image as claimed in claim 22, wherein it includes at least one monochromatic printed image (8*a*) having at least one emission peak wavelength in the green region, at least one monochromatic printed image (8*b*) having at least one emission peak wavelength in the red region and at least one monochromatic printed image (8*c*) having at least one emission peak wavelength in the blue region.

24. A polychromatic image as claimed in claim 22, wherein the emission peak wavelengths of the monochromatic printed images (8*a,* 8*b,* 8*c*) are separated by the same spectral distance of between 80 nm and 100 nm, in particular of the order of 90 nm.

25. A polychromatic image as claimed in claim 23, wherein the monochromatic images (8*a,* 8*b,* 8*c*) of the same set follow each other, in the order in which the light is received, in the order blue, red, green of the wavelengths of the emission peaks.

26. A polychromatic image as claimed in claim 22, wherein the photoluminescent pigments of at least the same set of monochromatic printed images (8*a,* 8*b,* 8*c*) emit under illumination by at least one source (14) of invisible light of which the spectral composition is situated in the ultraviolet or infrared regions.

27. A polychromatic image as claimed in claim 22, wherein the different photoluminescent pigments are adapted so as to have an emission peak wavelength under illumination by one and the same source (14) of invisible light.

28. A polychromatic image as claimed in claim 22, wherein it includes at least one first pigment which is photoluminescent under illumination by at least one first source of invisible light, and at least one second pigment which is photoluminescent under illumination by at least one second source of invisible light with a wavelength or with wavelengths distinct from that or those of the first source of invisible light.

29. An image as claimed in claim 22, wherein it includes a first set of positive monochromatic printed images (8*a,* 8*b,* 8*c*) including pigments which are photoluminescent under illumination by a first source of invisible light, in particular ultraviolet or infrared light, and adapted so as to reproduce a positive of an original polychromatic image (1) by additive synthesis, and a second set of negative monochromatic printed images (8*a,* 8*b,* 8*c*) including pigments which are photoluminescent under illumination by a second source of invisible light with wavelengths distinct from that of the first source of invisible light, in particular ultraviolet or infrared light, and adapted so as to reproduce a negative of an original polychromatic image (1) by additive synthesis.

30. An image as claimed in claim 22, wherein it additionally includes at least one image, known as an infrared image, visible in the infrared region but invisible in the visible light region under illumination by a source of visible light.

31. A device for protecting a document comprising at least one transparent protective film (9) for covering and protecting at least a portion of the surface (13) of a document (10), wherein the film (9) includes at least one image (8) as claimed in claim 22.

32. A document, in particular a passport, identity card, driving licence, vehicle registration document or other official identification or authentication document, a fiduciary document, a bank note, a cheque, a card or other document of payment, including at least one image (8) as claimed in claim 22.

33. A document wherein at least one image (8) as claimed in claim 22 is carried by at least one transparent protective film (9) applied to at least one face (13) of the document (10).

34. A photoluminescent printed polychromatic image produced by the process of claim 1.

* * * * *